US008839576B1

(12) United States Patent
Newcomb

(10) Patent No.: US 8,839,576 B1
(45) Date of Patent: Sep. 23, 2014

(54) GABLED-ROOF SKYLIGHT AND VENTILATION MEANS

(71) Applicant: Robert Newcomb, Mickleton, NJ (US)

(72) Inventor: Robert Newcomb, Mickleton, NJ (US)

( * ) Notice: Subject to any disclaimer, the term of this patent is extended or adjusted under 35 U.S.C. 154(b) by 0 days.

(21) Appl. No.: 13/960,043

(22) Filed: Aug. 6, 2013

(51) Int. Cl.
*E04B 7/18* (2006.01)
*E04D 13/03* (2006.01)

(52) U.S. Cl.
CPC ..... *E04D 13/0325* (2013.01)
USPC ..... 52/200

(58) Field of Classification Search
CPC ..... E04D 13/00; E04D 13/03; E04D 13/0305; E04D 13/032; E04D 13/0325; E04D 13/033; E04D 13/0335; E04D 13/035
USPC ..... 52/198–200
See application file for complete search history.

(56) References Cited

U.S. PATENT DOCUMENTS

| | | | | |
|---|---|---|---|---|
| 4,428,169 | A * | 1/1984 | Tsakiris | 52/200 |
| 4,484,424 | A * | 11/1984 | Logsdon | 52/199 |
| 4,621,569 | A | 11/1986 | Fioratti | |
| 5,212,913 | A | 5/1993 | Whitehead | |
| 6,079,167 | A | 6/2000 | Voegele, Jr. | |
| 6,361,434 | B1 * | 3/2002 | Brandon | 454/365 |
| 6,450,882 | B1 * | 9/2002 | Morris et al. | 454/365 |
| 6,623,354 | B2 * | 9/2003 | Morris et al. | 454/365 |
| 6,662,510 | B2 * | 12/2003 | Rotter | 52/199 |
| 6,981,916 | B2 * | 1/2006 | Coulton | 454/365 |
| 7,137,224 | B2 * | 11/2006 | Rasmussen et al. | 52/96 |
| 7,384,331 | B2 * | 6/2008 | Coulton | 454/365 |
| 7,393,273 | B2 * | 7/2008 | Ehrman et al. | 454/365 |
| 7,594,363 | B2 * | 9/2009 | Polumbus et al. | 52/199 |
| 8,176,691 | B2 * | 5/2012 | Rasmussen et al. | 52/95 |
| 8,221,200 | B2 * | 7/2012 | Oaten | 454/186 |
| 8,273,980 | B2 * | 9/2012 | Farquhar et al. | 136/251 |
| 2005/0126088 | A1 * | 6/2005 | Rotter | 52/198 |
| 2005/0136831 | A1 * | 6/2005 | Coulton | 454/365 |
| 2005/0241248 | A1 * | 11/2005 | Ridenour | 52/198 |
| 2006/0079173 | A1 * | 4/2006 | Coulton et al. | 454/365 |
| 2006/0154597 | A1 * | 7/2006 | Coulton et al. | 454/365 |
| 2007/0000192 | A1 * | 1/2007 | Mantyla et al. | 52/199 |
| 2007/0130850 | A1 * | 6/2007 | Miekka | 52/198 |
| 2008/0216442 | A1 * | 9/2008 | Shubin | 52/741.4 |
| 2010/0132275 | A1 * | 6/2010 | Stanger | 52/173.3 |
| 2011/0168165 | A1 * | 7/2011 | Puriri | 126/621 |
| 2011/0201266 | A1 * | 8/2011 | Henderson | 454/365 |
| 2013/0167833 | A1 * | 7/2013 | Daniels et al. | 126/621 |

* cited by examiner

*Primary Examiner* — Mark Wendell
*Assistant Examiner* — Keith Minter
(74) *Attorney, Agent, or Firm* — Daniel Boudwin; Global Intellectual Property Agency LLC

(57) ABSTRACT

An multi-layered roof skylight is provided that allows for natural light to enter through the peak of a gabled roof, while blocking ultraviolet light and offering an optional means to vent hot air and gases from inside the structure. The skylight comprises a first and second polycarbonate base layer attached to a structure's roof, wherein a polycarbonate roof cap is disposed thereabove and over the peak of the roof. The layers are sandwiched together by a line of fasteners on each side of the roof, while a first and second venting layer may further be provided between the base layers and the cap to allow air to vent therethrough. The cap is an angled member or one that has a defined shape incorporating vents in its design. Further provided is a method of installing the vented skylight on a gabled roof.

11 Claims, 5 Drawing Sheets

GABLED-ROOF SKYLIGHT AND VENTILATION MEANS

BACKGROUND OF THE INVENTION

1. Field of the Invention

The present invention relates to vents and skylights for gabled roof buildings. More specifically, the present invention pertains to a gabled roof skylight that allows natural light to enter the space while blocking ultraviolet light, and further provides venting apertures for allowing hot air and gases to escape the area without compromising roof waterproofing.

Preformed sheds and outhouses are common residential structures that increase storage space for the owner and provide a work area for fabricating articles, maintaining vehicles, and tending to hobbies. The most common construction of these structures is the gabled roof construction, wherein the roof is comprised of a first and second slanted section that meets at a peak. The gabled roof adds additional space above the next lowest level and also facilitates water drainage from the roof, where flat roofs tend to pool water and are prone to leakage. These roofs are generally covered by asphalt shingles and are comprised of wooden frames that meet at the peak.

One common issue with shed and outhouse structures is their lack of interior lighting. Some of these structures include electrical wiring for artificial lighting, while those that are used purely for storage tend to be disconnected from any electrical source and thus have unlit interior spaces. This makes accessing and searching the structure more difficult, particularly in twilight and low light conditions, as the user is required to utilize a flashlight or other artificial light source to search the outhouse. This is even a problem during daylight hours, as the sunlight cannot penetrate the roof and illuminate the interior space, making it more difficult for the user to navigate the structure interior.

A second common issue with sheds and outhouse work areas is the lack of ventilation. Air is trapped within the gabled roof and prevented from easily escaping. This can cause a shed to become very hot during summer months, and can also cause problems if a user is operating equipment within the structure (e.g. welding operations, etc.). The inability to remove the hot air or vent noxious fumes can be hazardous to those inside and be harmful to equipment stored therein.

The present invention pertains to a new and novel, gabled-roof skylight and venting system that allows natural light to penetrate the roof while also allowing for air ventilation therethrough. This is accomplished without compromising the waterproofing of the roof or requiring significant structural changes to the roof structure during installation. The device comprises a UV-resistant, transparent material that is installed along the peak of a gabled roof and across the existing roof beams. The device replaces shingles along the roof peak and is overlaid with adjacent shingles, while the design of the device allows for air ventilation without water readily entering therethrough. Overall, the device is provided for use in improving interior natural lighting and venting hot air from attics or outhouse structures.

2. Description of the Prior Art

Devices have been disclosed in the prior art that relate to skylights and roof vents. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

Devices in the prior art largely relate to either skylight assemblies or ventilation devices that allow the escape of gases from an interior space. The skylights of the prior art generally require structural changes in the roof to incorporate the assembly, which is limiting in its application area and requires extensive work to install the assembly. Ventilation devices in the prior art relate specifically to communicating air through the roof and out of the underlying area. While useful for their given requirements, these items fail to anticipate the gabled roof skylight and ventilation assembly of the present invention. The present invention requires minimal updates to the roof to install, and thereafter combines the functions of a skylight with that of a ventilation device.

One such device in the prior art is U.S. Pat. No. 5,212,913 to Whitehead, which discloses a roof ridge fitting for securing two adjacent sections of roof together at an angle and permitting light to pass therethrough. The device comprises a first and second end channel that accepts the roof panels therein. Between the channels is a thin, elongated interface that can be bent to match a desired roof angle. The material allows light to pass therethrough while supported by adjacent roof panels and fastened thereto. The Whitehead device comprises a sunlight-penetrable roof panel, however it lacks an ability to allow gases to escape therethrough and its structure is divergent from that of the present invention.

Another device is U.S. Pat. No. 4,621,569 to Fioratti discloses a roof ventilation means that acts as a gas extractor to regulate the natural ventilation within a building. The device comprises an air flow means that include upwardly angled blades that allow air to readily pass through the device while restricting cross winds from entering the same, thereby ensuring proper air flow out of the building and reduced pressure above the device that would otherwise stifle air movement through the device. While providing a means to communicate air from the roof of a building, the Fioratti device is directed to just that, an indoor air extractor. The present invention pertains to a gabled roof attachment that allows natural light to enter while also offering a ventilation means.

Finally, U.S. Pat. No. 6,079,167 to Voegele, Jr. discloses a pitched roof skylight assembly that allows for unrestricted thermal expansion and contraction of metallic roofing. The assembly comprises a flexible, domed-shaped skylight element that is installed between roof structures, whereby the skylight allows for light penetration therethrough and allows the roof itself to shift and introduce load into the skylight during thermal cycling. The device acts as a bellows and a functional skylight device. While providing a skylight for a roof structure, the Voegele, Jr. device fails to anticipate the elements of the present invention, wherein a vented, UV-resistant skylight for a gabled roof structure is provided.

The present invention provides a structure that replaces the upper most roof panels and shingles along the peak of a gabled roof and positions a UV-resistant skylight and venting means, whereby natural light is permitted to enter through the roof peak and into the structure. The device comprises a multi-layered assembly that allows light to penetrate therethrough while offering an optional air ventilation layer to allow gases to escape through the peak of the roof. The assembly can be installed in conjunction with a new structure or placed on an existing roof, wherein the roof panels and uppermost shingles are modified without compromising the moisture blocking qualities of the roof.

It is submitted that the present invention is substantially divergent in design elements from the prior art, and consequently it is clear that there is a need in the art for an improvement to existing roof skylight and vent devices. In this regard the instant invention substantially fulfills these needs.

SUMMARY OF THE INVENTION

In view of the foregoing disadvantages inherent in the known types of roof skylight and venting structures now present in the prior art, the present invention provides a new assembly that can be utilized for providing convenience for the user when natural interior light is desired within an interior space below a gabled roof, and further when venting of hot air or gases is desired by the user.

It is therefore an object of the present invention to provide a new and improved a roof skylight and venting structure that has all of the advantages of the prior art and none of the disadvantages.

It is another object of the present invention to provide a roof skylight and venting structure that provides a means to allow natural light into an interior structure while simultaneously blocking harmful ultraviolet light, whereby the material of the assembly naturally blocks ultraviolet light while still allowing visible light to penetrate therethrough.

Another object of the present invention is to provide a roof skylight and venting structure that can be installed on an existing roof or installed as part of the original roof construction, whereby the roof panels and shingles are removed along the roof peak for positioning the skylight assembly thereover.

Yet another object of the present invention is to provide a roof skylight and venting structure that is comprised of a durable construction and simple set of installation procedures, whereby the assembly is fastened together and against the roof, and thereafter sealed around its edges to prevent water penetration therethrough.

Another object of the present invention is to provide a roof skylight and venting structure that includes optionally installed venting layers or a skylight cap design that incorporates venting apertures in its design to allow air escape from the structure interior.

Another object of the present invention is to provide a roof skylight and venting structure that does not compromise the moisture seal of the roof or expose the structure owner to leaking.

A final object of the present invention is to provide a roof skylight and venting structure that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
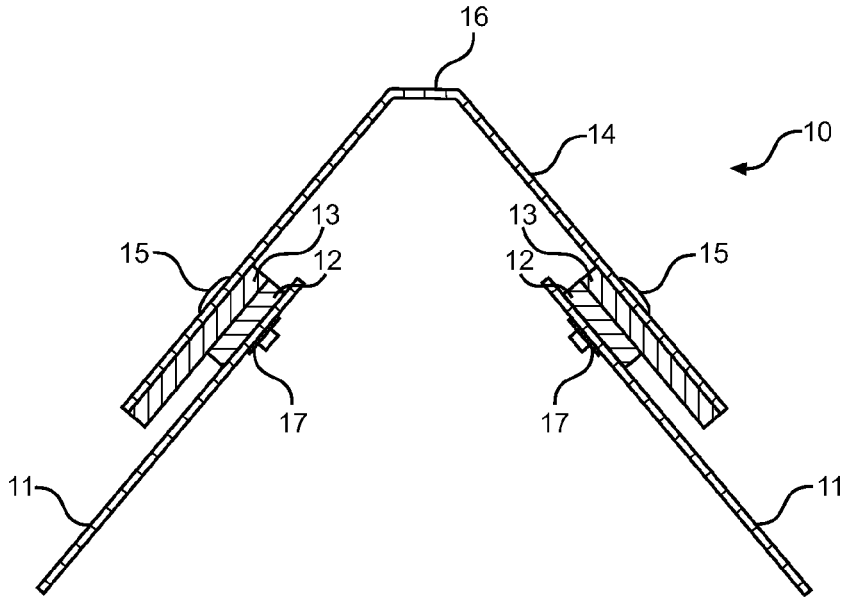
FIG. 1 shows a cross section end view of the multi-layered embodiment of the present invention, wherein the assembly comprises a sandwiched construction and includes a venting layer.

Reference is made herein to the attached drawings. Like reference numerals are used throughout the drawings to depict like or similar elements of the roof skylight and venting structure. For the purposes of presenting a brief and clear description of the present invention, the preferred embodiment will be discussed as used for providing a means to send natural light into an interior space through a gabled roof, while offering a means of venting gases through the structure for improved thermal efficiency of the building and for venting noxious gases from within the building interior. The figures are intended for representative purposes only and should not be considered to be limiting in any respect.

Referring now to FIG. 1, there is shown a cross section end view of the skylight and venting structure of the present invention. In this view, the multi-layered embodiment of the structure is visualized from one end, wherein this contemplated construction allows for modular installation and for the placement of optional vents along the skylight length. The lowermost layer of the assembly comprises a first and second base layer 11 that is adapted to be placed against the roof shingles of a roof along opposing sides of the roof line. These base layers 11 are fastened directly to the roof shingles therebelow, wherein the shingles and roof panels are removed about the peak of the roof for the skylight cap 14 to be positioned over the gap in roof structure for the passage of natural light and for venting air.

The skylight cap 10 is an angular hat structure having a pair of angled hat webs 14 and a flattened hat cap region 16. The cap 10 is adapted to cover a gabled roof peak, wherebelow the roof panels have been removed or cut away and the shingles have likewise been removed from directly under the cap 10. With the roof panels and shingles removed in this region, natural light can penetrate the cap 10, which comprises a transparent material, and enter the interior of the building structure. It is preferred that both the base layers 11 and the cap 10 be comprised of a transparent material, and preferably a polycarbonate material that naturally blocks ultraviolet light.

Sandwiched between the cap webs 14 and the base layers 11 is an optional venting layer, which comprises at least one vented structure that is secured through the cap webs 14, base layers 11 and the roof panels therebelow by a common line of fasteners 15 and securing fastener nuts 17. The venting structures comprise a first, elongated layer 13 and a second, narrower layer 12 that combine to provide a plurality of apertures along the length of the assembly for air to pass therethrough. In hot environments, hot air from within a roof is vented through the venting layer to reduce captured heat within a building, thereby lowering energy costs to cool the building interior. The vents can also be used to vent noxious fumes inside an otherwise sealed roof structure, whereby welding gases, fuel fumes, and exhaust gases can be vented therethrough. The venting layer may comprise a singular venting layer, or a plurality thereof to increase the venting area and the number of vents in the assembly cross section.

Figure 2:
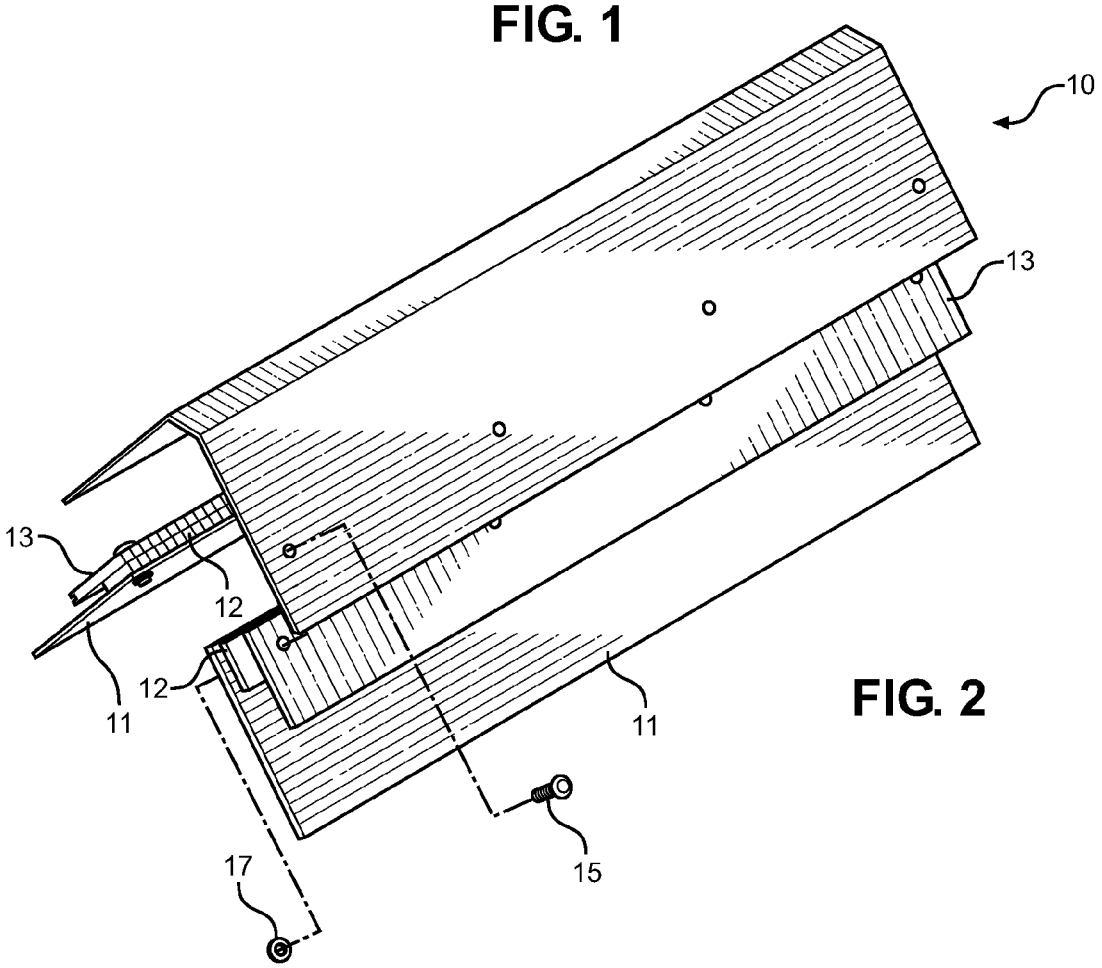
FIG. 2 shows an exploded perspective view of the multi-layered embodiment of the present invention.

Referring now to FIG. 2, there is shown an exploded perspective view of the multi-layered embodiment of the present invention, whereby the multi-layered assembly is provided for allowing natural light and air to pass therethrough. As shown, the venting layers 12, 13 are sandwiched between the skylight cap 10 and the base layers 11. A row of fasteners 15 extends through each layer to secure the members together along the length of the assembly and along the length of the gabled roof.

During installation of the multi-layer assembly embodiment onto an existing roof, the roof peak is prepared by cutting away a section of roof sheathing panels and remove the shingles thereon along both sides of the roof peak and to an equal distance from the peak. This opens the roof peak to the outside environment and exposes the roof rafters and the roof ridge board (if one is installed along the roof). A layer of underlayment, waterproofing material and roof singles are then re-applied to the roof up to the cut-out. The base layers 11 of the skylight assembly are then fastened over the shingles adjacent to the cut-out, whereby the base layers 11 act as a nailing flange for the entire assembly. Thereafter, the venting layers 12, 13 and cap 10 can be fastened to the base layer using threaded fasteners 15, rubber washers and fastener nuts 17. The assembly is extended beyond the outer extents of the roofline cutout in the lengthwise direction to overlap shingles along the ends of the cutout, while the width of the base layer 11 provides extended coverage over the sides of the cut-out. The ends and sides of the base layer are then sealed using a clear polymer seal to prevent any potential leaks. Once installed, natural light and air can pass through the transparent skylight assembly, passing through the roof cut-out from the structure interior.

Figure 3:
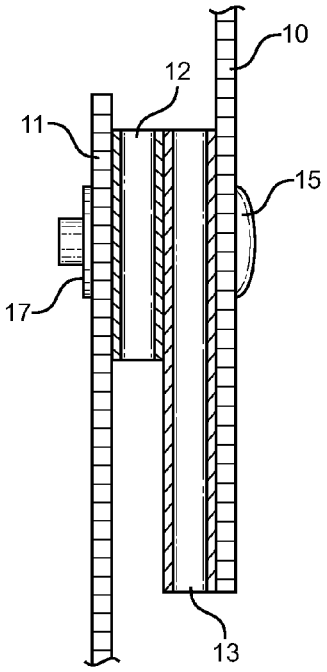
FIG. 3 shows a close-up end view of the sandwiched elements of the multi-layered assembly.

Referring now to FIG. 3, there is shown a close-up view of the joint between the base layer 11, the venting layers 12, 13, and the skylight cap 10. In the multi-layered embodiment of the present invention, the cap 10 and base layer 11 sandwich together intermediate venting layers 12, 13 (or singular venting layer) to permit air penetration through the assembly when installed. This joint includes a threaded fastener 15, a fastener nut 17, and rubber washer to secure the assembly together along its length, while the base layer 11 acts as a nailing flange through which nail fasteners are penetrated. The material of the base layer 11 is such that pre-drilling is not required, where the material is preferably a polycarbonate material.

As visualized in FIGS. 1 and 3, the base layer is preferably extended farther inward toward the skylight cap flattened hat cap region than that of the upper extent of the intermediate venting layers 12, 13. In this configuration, the base layer 11 extends beyond the intermediate venting layers 12, 13 such that the base layer 11 can catch and corral condensation along the roof line and guide it through the venting layers 12, 13. By extending this base layer 11 upwards, moisture in the cap can condense and flow more readily into the venting layers 12, 13, preventing trapped moisture that can lead to water damage or leaks.

Figure 4:
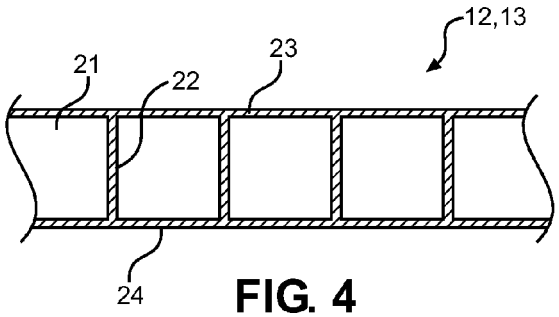
FIG. 4 shows an overhead view of the venting layer and its open architecture.

Referring now to FIG. 4, there is shown a side view of one of the venting layers 12, 13. The venting layer comprises a first 23 and second 24 surface separated by a plurality of intermediate web members 22 that separate the first and second surfaces and provide an air gap 21 therebetween. The surfaces 23, 24 and the webs 22 create small rectangular openings that allow air to pass therethrough. When secured between the cap and base layer of the multi-layered assembly, the air gaps 21 provide a means to vent hot air and gases from within the interior side of the roof. The downward-positioning of the venting layer prevents water from entering thereinto and thus entering the interior of the structure after the assembly is installed. Therefore, rainfall, melting ice and snow cannot make its way through the sky light assembly vents when installed properly. When multiple venting layers are utilized between the cap and base layers, the length of each vent layer outward length can be progressively tapered so a lowermost venting layer is not exposed to rain and the entrance to the air gaps thereof are placed progressively inward toward the peak of the roof. In an alternate embodiment, crossing web members in an "X" configuration can be disposed between the web members 22 to reduce the cross section of the venting layer 12, 13. This prevents large insect and animals from entering therethrough, while still offering moisture communication across the layer.

Figure 5:
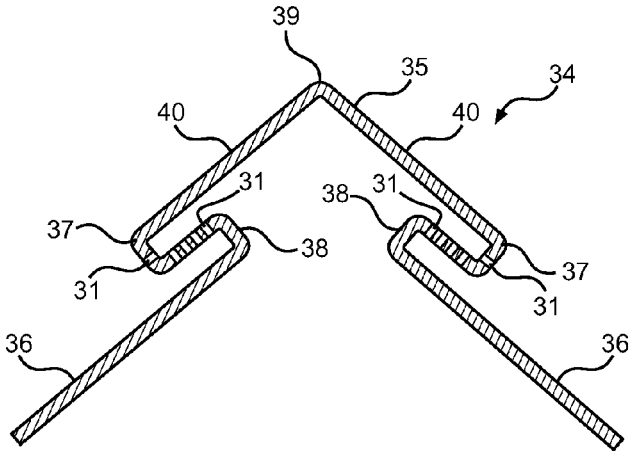
FIG. 5 shows a view of an alternate embodiment of the venting cap, which incorporates the base layer and venting layers in a singular piece design.

Referring now to FIG. 5, there is shown a cross section end view of a single-piece embodiment 34 of the present invention. In this embodiment, the skylight and venting assembly is encompassed within a single, continuous structure having a defined length and a formed cross section that does not require piecemeal assembly or fastening to hold its shape. This embodiment comprises a first and second nailing flange 36 that have a lower edge and form into an elevated cap 35 thereabove. The elevated cap is adapted to be positioned slightly above the roof peak, as opposed to more directly thereover, as is provided in the multi-layered construction of the present invention.

The elevated cap 35 comprises an angled member having a central peak 39 and a first and second angled web 40 surface. Between the elevated cap 35 and the nailing flange 36 is a soffit that comprises an interior bend 38 and an exterior bend 37 that form an overhang region for placement of a plurality of apertures 31 therethrough. When installing the single piece embodiment of the present invention, the peak 39 of the cap 35 is placed directly over the peak of the roof as the nailing flanges 36 are fastened through the adjacent roof shingles. Similar to the multi-layered embodiment, the single piece embodiment 34 is comprised of a transparent, ultraviolet light-blocking material that is adapted to receive nail fasteners through the nailing flange without pre-drilled holes. Preferably this material is polycarbonate.

Figure 6:
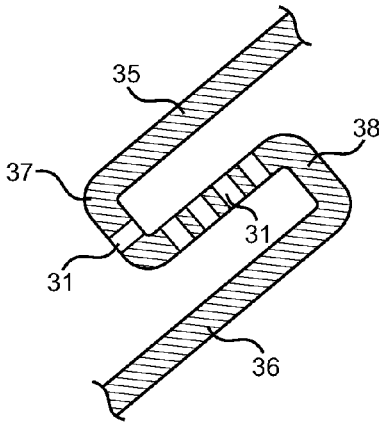
FIG. 6 shows a close-up end view of the single piece embodiment.

Referring now to FIG. 6, there is shown a close-up, detail view of the soffit region of the single-piece embodiment of the present invention. The soffit is provided by an outward bend region 37 and an inward bend region 38 separating the upper cap 35 and the lower nailing flange 36. These elements are formed as a single piece, wherein the soffit provides a region through which to place venting apertures 31 therethrough. Placement of the apertures 31 prevents water penetration while offering significant air flow therethrough. The apertures and the shape of the soffit provide that trapped moisture and condensation within the device can be collected and drained therefrom without falling into the interior space.

Figure 7:
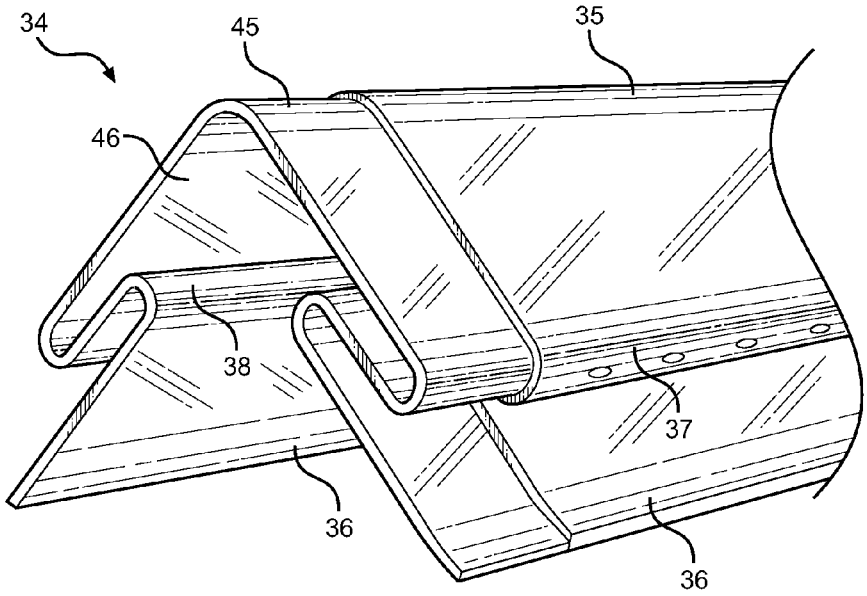
FIG. 7 shows an end view of the single piece embodiment and its tapered edge for joining adjacent sections.

Referring now to FIG. 7, there is shown an end view of the single-piece embodiment 34 of the present invention. It is contemplated that specific lengths of the skylight will be produced and installed, wherein several lengths may be necessary to span a given roof top length. For shorter lengths utilized to span a larger run, the shorter lengths are abutted against one another with an overlapping section. For the single piece embodiment 34, one end of the device comprises a female end shelf region 45 that is of reduced thickness than the rest of the length, wherein the second end further comprises a male shelf region that is a mirrored configuration with respect to the female such that two sections can be aligned and interconnected to reduce gaps therebetween and create an overlapping area. The overlapping area is fastened to the roof through the overlapping nailing flanges 36, while the elevated caps 35 and soffits 38 align with one another to create a largely continuous run.

Figure 8:
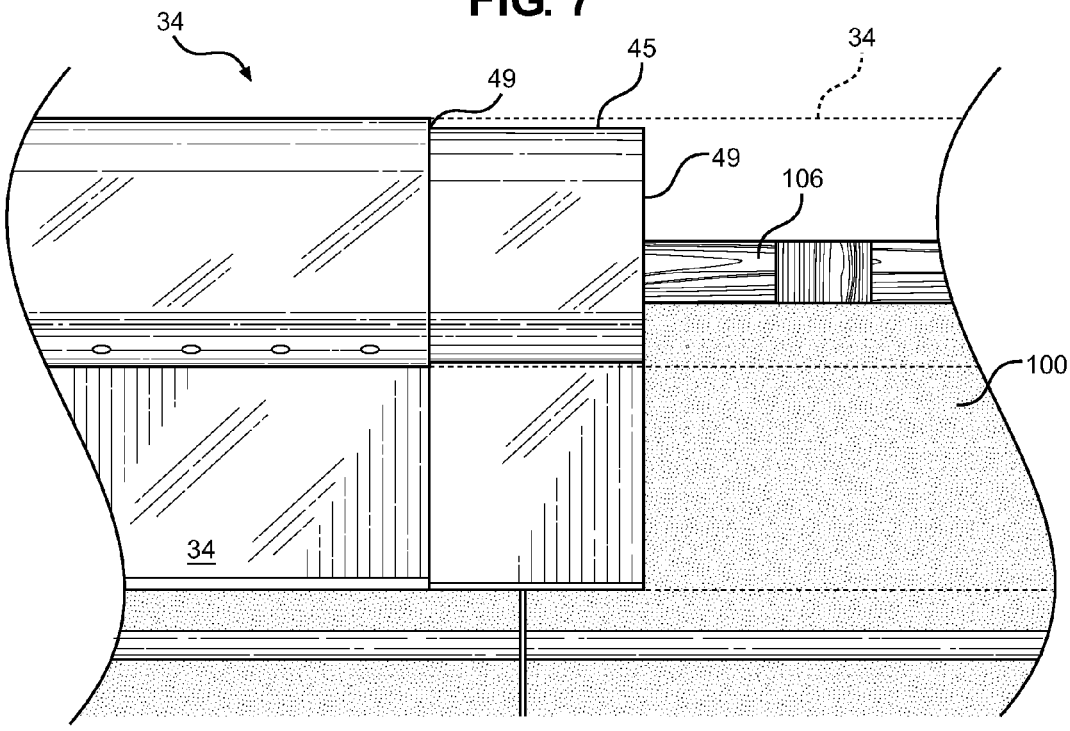
FIG. 8 shows a view of the single piece embodiment at its termination.

Referring now to FIG. 8, there is shown a side view of the single piece embodiment 34 at its termination 48. The termination 48 comprises a shelf region 45 of reduced cross section, wherein a shelf 49 transitions the device 34 from its designed thickness to the shelf region 45 thickness. When installed, the nailing flange 36 of the skylight 34 is nailed into the underlying shingles 100 adjacent to the opening 106 in the roof peak. Adjacent lengths of the skylight 34 are aligned and installed over the roof opening, whereafter the open ends are capped with an air filter element (see FIG. 10).

Figure 9:
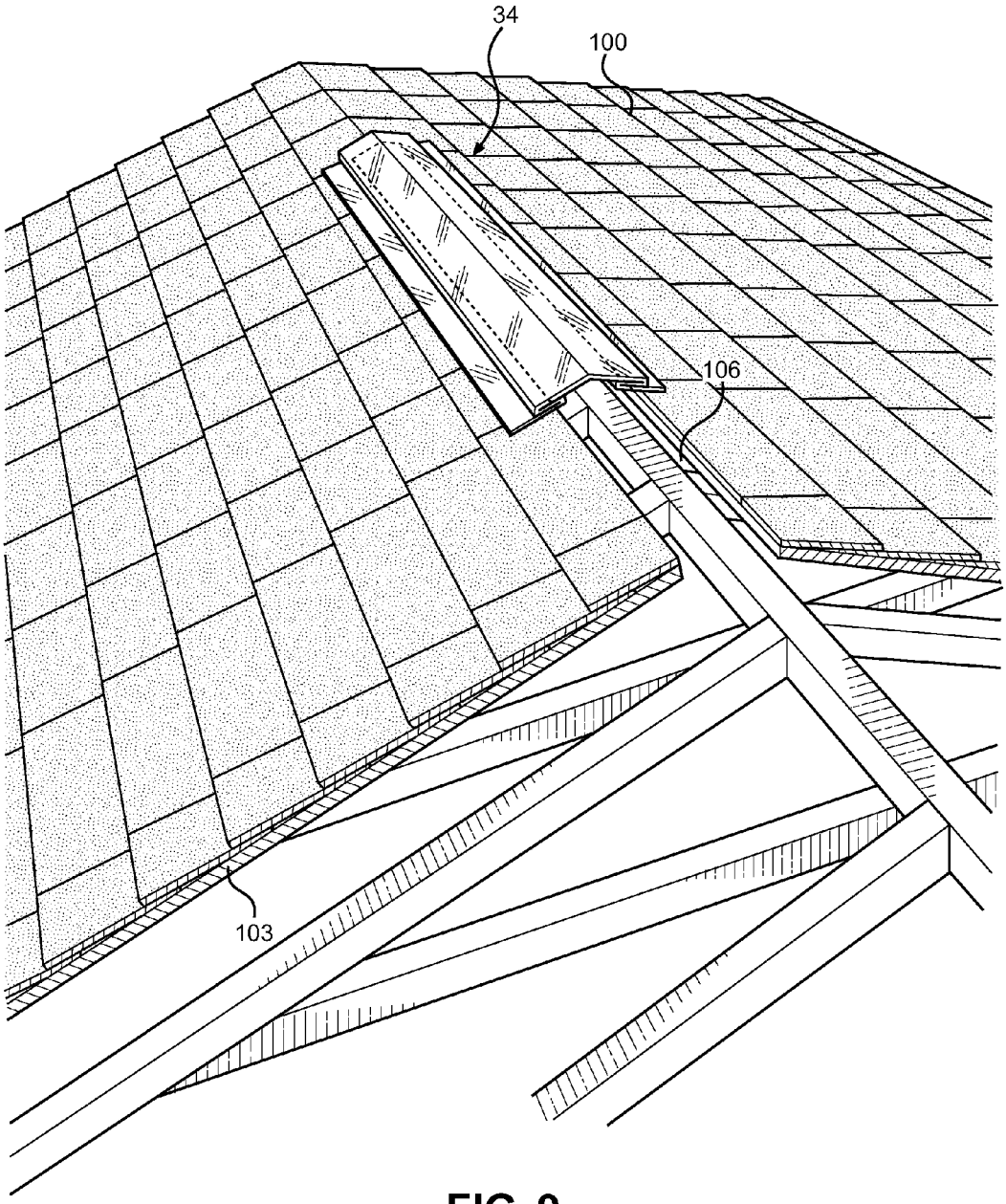
FIG. 9 shows an overhead view of an embodiment of the present invention installed on a gabled roof.

Referring now to FIG. 9, there is shown an overhead view of the single piece embodiment 34 of the present invention installed over the opening 106 created at the peak of a roof. When installed the skylight of the present invention, in either embodiment, the roof peak is opened by first removing shingles 100 therefrom and cutting away roof panel 103 to expose the interior of the structure to the open environment. Once the opening 106 is created, the skylight 34 can be nailed through the shingles 100 and panels 103 adjacent to the opening 106 to secure the skylight 34 in position. The ends of the skylight are then caulked (in the case of the multi-piece embodiment) or sealed using an air filter element (in the case of the single piece embodiment).

Figure 10:
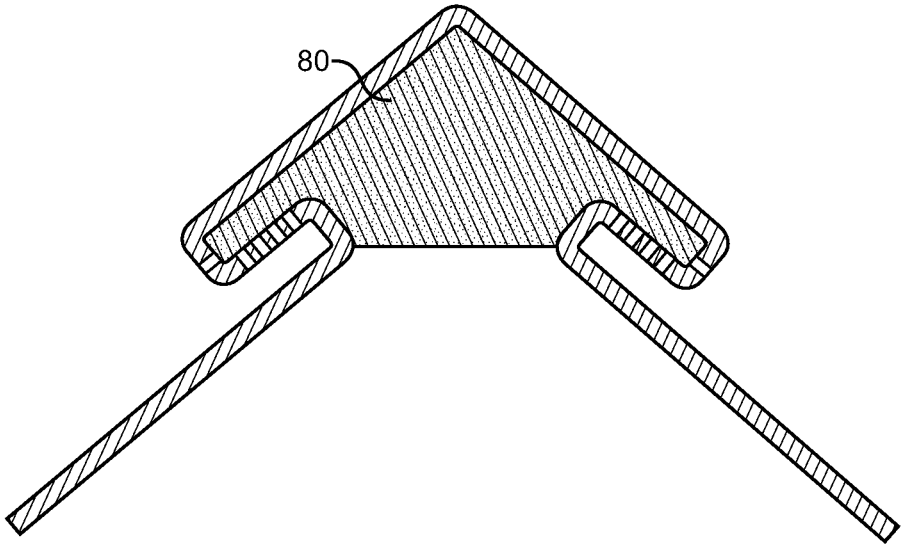
FIG. 10 shows a cross section view of the present invention in conjunction with an end cap that seals the open ends of the device after installation.

Referring finally to FIG. 10, there is shown an end view of the single piece embodiment of the present invention and a contemplated end cap filter element 80. The end cap 80 is adapted to be placed within the interior of the skylight end, wherein the end cap 80 includes a female section to be inserted into the skylight end and slightly protrude therefrom. This seals the end of the skylight, which is slightly elevated above the roof line, and prevents moisture from freely entering therethrough. The end cap 80 is preferably air permeable to allow more air flow into the building; however the end cap 80 maintains a water tight seal on the end of the skylight to prevent leaking.

The use of polycarbonate as a material is useful for both installation reasons and for preventing harmful ultraviolet light from entering the building interior through the skylight. Polycarbonate naturally blocks ultraviolet light, which can cause fading of interior furniture or articles stored therein. This is particularly important if the skylight is used on the roof of a storage shed, where valuables may be placed for long-term storage. Prolonged exposure to sunlight can fade and deteriorate articles therein. Polycarbonate further assists installers, as its offers a nailing flange that is capable of accepting nail fasteners therethrough without pilot holes or predrilling, wherein the flange will not easily crack or fail during this exercise. Polycarbonate is also slightly flexible, lightweight, and not prone to easily cracking like other transparent materials may be. This allows installers to easily handle the assembly and install without fear of causing damage thereto.

Overall, the device serves as an alternative to installing ridge-venting or roof windows (skylights) on any gabled roof structure, wherein the present invention provides a combined structure to utilize sunlight to illuminate interior spaces below the device while venting harmful air from the same. The device is designed for use on residential attics and garden sheds where venting and light are both desired. Both embodiments of the device are preferably comprised of an ultraviolet blocking polycarbonate, or any similar transparent, ultra-violet protected material, such as fiberglass or composite materials. The device includes a low profile roof and when installed, picks up existing roof colors (shingles) on the building, causing a camouflage effect that hides its presence better than dedicated skylight assemblies or overhead vents.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vented skylight assembly, comprising:

a skylight cap having a hat structure configuration comprising a pair of angled hat webs, a flattened hat cap region, and upper surface and an underside surface;

a first and second base layer having an upper surface and an underside surface;

at least one venting layer sandwiched between said underside surface of said angled hat webs and said upper surface of said base layers;

said hat webs, base layer, and venting layer being fastened together;

said at least one venting layer comprising a first and second surface separated by a plurality of intermediate web members that separate the first and second surfaces and provide an air gap therebetween;

said skylight cap adapted to be placed over an exposed gabled roof peak and said angled hat webs adapted to be fastened to said roof about said exposed gable roof peak;

said skylight cap comprising a transparent material.

2. The vented skylight assembly of claim 1, wherein said skylight cap transparent material further blocks ultraviolet light.

3. The vented skylight assembly of claim 1, wherein said base layers and said venting layers are comprised of transparent material.

4. The vented skylight assembly of claim 1, wherein said transparent material further blocks ultraviolet light.

5. The vented skylight assembly of claim 1, wherein:

said first and second base layer further comprises an upper extent and said at least one venting layer comprises an upper extent;

said upper extent of said base layers being positioned higher along said gabled roof peak than said upper extent of said venting layer.

6. The vented skylight assembly of claim 1, wherein said at least one venting layer further comprises cross members within said air gap adapted to reduce said air gap size.

7. A vented skylight, comprising:

an elongated section comprising an elevated cap, a first and second nailing flange, and a first and second soffit positioned between said elevated cap and first and second nailing flange;

said elevated cap, first and second nailing flange, and first and second soffits comprising a formed section;

said first and second soffit comprising an interior bend and an exterior bend that each form an overhang above each nailing flange;

at least one aperture through said soffit adapted to allow airflow therethrough;

said elevated cap adapted to be placed over an exposed gabled roof peak and said angled nailing flanges adapted to be fastened to said roof about said exposed gable roof peak;

said elongated section comprising a transparent material.

8. The vented skylight of claim 7, wherein said elevated cap further comprises a peak and a first and second angled web surface.

9. The vented skylight of claim 7, wherein said transparent material of said elongated section further blocks ultraviolet light.

10. The vented skylight of claim 7, wherein said at least one aperture through said soffit comprises a plurality of apertures through said overhang of said soffit.

11. The vented skylight of claim 7, wherein said at least one aperture through said soffit comprises a plurality of apertures through said exterior bend of said soffit.

* * * * *